United States Patent [19]

Logan et al.

[11] 4,326,976

[45] Apr. 27, 1982

[54] COMPOSITION AND PROCESS FOR WASHING AND BLEACHING

[75] Inventors: William R. Logan, Ottenburg; Pierre Sarot, Vilvoorde; Edmond Bouillet, Brussels, all of Belgium

[73] Assignee: Interox, Brussels, Belgium

[21] Appl. No.: 30,901

[22] Filed: Apr. 17, 1979

[30] Foreign Application Priority Data

Apr. 17, 1978 [FR] France ..... 78 11637

[51] Int. Cl.[3] ..... C11D 7/38; C11D 7/18

[52] U.S. Cl. ..... 252/99; 252/95; 252/174.14; 252/174.15; 252/131; 252/381; 252/383

[58] Field of Search ..... 252/95, 99, 174.14, 252/174.15, 131, 381, 383

[56] References Cited

U.S. PATENT DOCUMENTS

| | | | |
|---|---|---|---|
| 2,498,344 | 2/1950 | Rider et al. | 252/99 X |
| 2,625,513 | 1/1953 | Kirschenbauer | 252/131 |
| 2,625,514 | 1/1953 | Kirschenbauer | 252/131 |
| 2,940,935 | 6/1960 | Reich | 252/109 |
| 2,975,142 | 3/1961 | Schmidt et al. | 252/99 X |
| 3,116,185 | 12/1963 | Wilson et al. | 252/383 X |
| 3,868,336 | 2/1975 | Mazzola et al. | 252/135 |

FOREIGN PATENT DOCUMENTS

| | | |
|---|---|---|
| 1192524 | 5/1970 | United Kingdom . |
| 1339257 | 11/1973 | United Kingdom . |
| 1473202 | 5/1977 | United Kingdom . |

*Primary Examiner*—Mayer Weinblatt

*Attorney, Agent, or Firm*—Spencer & Kaye

[57] ABSTRACT

Particulate washing and bleaching compositions containing a peroxy compound and an alkali carbonate have their tendency to cake during storage reduced by incorporating within the compositions an alkaline aryl sulphonate, such as sodium methyl naphthalene sulphonate, and a water-insoluble inorganic compound, such as magnesium trisilicate. The compositions can be used for washing and bleaching textiles and fibers and cleaning hard surfaces.

15 Claims, No Drawings

COMPOSITION AND PROCESS FOR WASHING AND BLEACHING

BACKGROUND OF THE INVENTION

The present invention relates to particulate compositions for washing and bleaching and to a process for washing and bleaching using such compositions.

It is well known that peroxy compounds, such as sodium perborate, percarbonate and persulphate in the form of particles, can be incorporated in particulate washing and bleaching compositions in order to improve their bleaching power. To improve the effectiveness of a washing process and to facilitate the removal of soil, an alkali, e.g. sodium carbonate, again in particulate form, can be incorporated into these compositions. This has the additional advantage of conferring an alkaline pH to the washing or bleaching baths.

However, compositions for washing and bleaching which contain both of these two types of compounds simultaneously have a tendency to agglomerate, or cake, easily when stored in a highly humid atmosphere, thereby making such compositions very difficult to pour and thus difficult to use in automatic washing machines.

SUMMARY OF THE INVENTION

It is an object of the present invention, based on applicants' discoveries, to provide particulate compositions for washing and bleaching in which the aforementioned disadvantages are ameliorated and which tend not to exhibit caking to the same extend even after a long period of storage in a humid atmosphere.

A more specific object of the invention is to provide particulate compositions for washing and bleaching, which are resistant to caking and contain particles of an alkali carbonate and a peroxy compound, and which also contain particules of an alkaline aryl sulphonate and waterinsoluble inorganic compound.

A further specific object of the present invention is to provide a process for the reduction of the tendency to cake of a particulate mixture of alkali carbonate and peroxy compound, which is carried out by mixing the particulate mixture with particulate anticaking agent comprising an alkaline aryl sulphonate and a water-insoluble inorganic compound.

By the term "water-insoluble inorganic compound" is meant any inorganic compound whose solubility in water is less than 1% by weight. In general, such water-insoluble compounds are selected from among either magnesium compounds or silicon compounds and aluminum compounds, particularly compounds derived from silica or alumina. The following magnesium compounds are especially suitable, namely magnesium oxide, magnesium hydroxide, magnesium carbonate (possibly hydrated), magnesium orthophosphate, magnesium pyrophosphate, magnesium metaborate, and magnesium orthoborate. The following silicon or aluminum compounds are especially suitable namely silica gel, amorphous silica, kaolinite, micas, zeolites, boehmite, aluminum phosphates, aluminum hydroxide, aluminum silicate, celite, kieselguhr and fuller's earth. Most frequently, magnesium salts of compounds derived from silica or alumina are used, such as talc, magnesium orthosilicate, magnesium metasilicate, magnesium trisilicate, vermiculite and forsterite. A single inorganic compound or a mixture of inorganic compounds can be used. Excellent results have been obtained with magnesium trisilicate which has the formula $2MgO.3SiO_2.nH_2O$.

The alkaline aryl sulphonates which are suitable according to the present invention are normally selected from among the compounds containing an aromatic group selected from benzene, naphthalene, phenanthrene, anthracene or diphenyl group. If desired, the aromatic group can be substituted by one or several, and generally by 1 to 3, alkyl groups. Each of these alkyl groups generally contains 1 to 6 carbon atoms. Good results are obtained using aryl sulphonates which are either unsubstituted or substituted by one or more alkyl groups containing 1 or 2 carbon atoms. The alkaline aryl sulphonates to be employed are advantageously selected from among the aryl sulphonates of alkali metals or ammonium. Most frequently, sodium or potassium aryl sulphonates are used. A single alkaline aryl sulphonate or a mixture of alkaline aryl sulphonates can be used. Excellent results are obtained using sodium methyl naphthalene sulphonate.

The mixture of particles of alkaline aryl sulphonate and water-insoluble inorganic compound, which is used as anticaking agent according to the present invention, is generally used in a ratio of from 0.01 to 40% by weight, and most frequently of from 0.05 to 20% by weight based on the total amount of alkali carbonate and peroxy compounds. Larger proportions of anticaking agent can be used, but they are generally unnecessary and relatively uneconomical. Smaller proportions of anticaking agent can also be used, but they are generally insufficient to ensure an appreciable anticaking effect during storage in a highly humid atmosphere.

Within the anticaking agent the relative amounts of alkaline aryl sulphonate and inorganic compound can vary within fairly wide limits. The weight ratio of the former to the latter is normally between 0.01 and 10, and most frequently between 0.02 and 5. Other ratios can also be suitable.

Highly satisfactory results are obtained by using 0.01 to 5%, by weight, of sodium methyl naphthalene sulphonate and 0.05 to 15%, by weight, of magnesium trisilicate (100%) in relation to the total weight of alkali carbonate and peroxy compound.

The alkali carbonate used according to the present invention generally consists of an alkali metal or ammonium carbonate. Most frequently, sodium carbonate is used.

The peroxy compounds used according to the invention are selected from among the percarbonates, persulphates and perborates of alkali metals or ammonium. Most frequently, those derived from the corresponding sodium salts are used. Usually, sodium percarbonate or the various qualities of sodium perborate with varying degrees of hydration are used.

The alkali carbonate and peroxy compounds can be used in wide range of ratios in the composition according to the present invention. In general, the weight ratio is between 0.05 and 20, and most frequently between 0.1 and 10. Other ratios are of course also suitable.

The proportion of peroxy compounds is, of course, selected as a function of its particular nature, and particularly as a function of its active oxygen content as well as of the particular use for which the composition is intended. In general, the components of the composition are selected to provide an active oxygen content of the composition at least equal to 0.1%, by weight, and preferably at least equal to 0.5%, by weight.

The compositions according to the invention generally contain at least 30%, by weight, and most frequently at least 40%, by weight, of active components. By the term "active components", is meant both the alkali carbonate and peroxy compounds. The remainder consists of the anticaking agent according to the invention, described herein, and fillers as well as other constituents selected within a large variety of types.

In general, the fillers, when present, are used in a ratio of from 0.01 to 70%, by weight, and most frequently of from 1 to 60%, by weight, of the composition. They consist of products which are inert under the conditions of washing and bleaching. These products are most frequently selected from among the alkali chlorides and sulphates and mixtures thereof. Sodium chloride and sulphate and mixtures thereof are frequently used with success. Other fillers are, of course, also suitable.

As stated before, the compositions according to the invention can also contain other constituents and these are normally selected according to the particular field of application of the compositions. Among these can be mentioned, cationic, anionic, nonionic, amphoteric or ampholytic surface active agents, persalt activators, optical brighteners, foam inhibitors, enzymes, graying inhibitors and soil antiredeposition agents, disinfectants, corrosion inhibitors, perfumes, coloring agents, pH regulating agents, agents capable of liberating active chlorine, peroxy compound stabilizers and agents capable of complexing the ions responsible for water hardness.

The overall concentration of these various other constituents does not generally exceed 20%, by weight, of the composition. Most frequently, they are present in a total proportion of 0 to 10%, by weight, of the composition.

The preparation of the solid compositions according to the invention can be effected in any manner known in itself. The anticaking agent can thus be added in the form of a mixture of solid particles, or in the form of a suspension of these particles in a liquid, generally water, to a mixture of solids containing the carbonate, the peroxy compounds and, possibly, the fillers and other constituents.

The particles of anticaking agent are generally used in the form of particles of small dimensions, i.e. in the form of particles having a mean diameter of less than 0.5 mm, and most frequently of less than 0.2 mm. Each particle of anticaking agent can simultaneously contain the two compounds forming the anticaking agent according to the invention. Most frequently, a mixture of particles containing respectively each of these two compounds is used.

The active components as well as the fillers and other possible constituents which make up the composition in particle form are used in the form of solid particles of varying dimensions, which are generally between 0.05 and 5 mm. The solid particles employed can each contain only one of the constituents of the mixture or can contain simultaneously a plurality of the constituents. The solid particles can be used in the dry or wet state. One suitable technique for the incorporation of the anticaking agent to form the composition according to the present invention consists of mixing an aqueous suspension of the anticaking agent in finely divided form with a particulate mixture containing the active components as well as the fillers and other possible constituents. Mixing can be effected in any way known in itself. It is thus possible to spray the suspension of anticaking agents onto the solid particulate mixture containing the active components, the fillers and other possible constituents, which are held in a fluidized bed. It is also possible to operate in conventional mixers such as mixers having rotating bases or drum mixers. The wet product obtained is subsequently dried. This latter operation can take place at the same time as the mixing operation.

Another technique for the incorporation of the anticaking agent consists of mixing the particulate mixture containing the active components as well as the fillers and other possible constituents in the dry state in various types of mixers known per se, such as fluidized beds and drum mixers. Examples of appropriate mixers are given in J. H. Perry, CHEMICAL ENGINEER'S HANDBOOK, Section 21/35–43, McGraw Hill Book Co. New York (1963). This particularly simple type of technique is often preferred for the preparation of the compositions according to the invention.

The compositions according to the invention can be used for washing and bleaching textiles and fibers, in dishwashers, for cleaning equipment, tanks, drains and surfaces of any kind whatsoever, for industrial or domestic use, such as for example, hand or machine washing of delicate clothes, washing in drum washing machines at high temperatures, prewashing, cleaning or ceramics, glass, metal, plastics, wooden surfaces, bleaching of cellulose (paper pulp, wood pulp, etc.) bleaching of oil and fats, etc.

The temperature at which these compositions can be used is generally between 0° to 130° C. In general, temperatures between 20° and 105° C. are used. The temperature is chosen in accordance with the nature of the article to be washed, cleaned or bleached and the technique used. The cleaning, washing and bleaching time is generally between 1 and 200 min, and generally a concentration of composition according to the invention of between 0.1 and 100 g of composition per liter water is used. When textiles are to be washed, it is possible to introduce into the washing medium, at the same time as the composition according to the invention, a second composition, this latter having a high content of surface active agents. In this case, the two compositions are used in largely equal proportions by weight.

The examples below are given in order to illustrate the properties of the composition according to the invention more clearly.

DESCRIPTION OF THE PREFERRED EMBODIMENTS

EXAMPLES

All the compositions examined below were prepared by mixing their various constituents in the form of solid particles in the dry state. Three base powders were prepared whose constituents, expressed as a weight percentage of the base powder, are given in Table I below. By the term "base powder" herein is meant a powder containing the peroxy compound and the alkali carbonate but containing neither of the components of the anticaking agent.

TABLE I

| Constituents of the base powder | Powder I | Powder II | Powder III |
|---|---|---|---|
| Sodium percarbonate | 30 | 30 | — |
| Sodium perborate tetrahydrate | — | — | 45 |

TABLE I-continued

| Constituents of the base powder | Powder I | Powder II | Powder III |
|---|---|---|---|
| Sodium carbonate | 60 | 40 | 45 |
| Sodium sulphate | 10 | 10 | 10 |
| Sodium chloride | — | 20 | — |

The resistance to caking of each of these base powders was examined in the absence of an anticaking agent, and in the presence of only one component and of both components of the mixture forming the anticaking agent according to the present invention.

The test for determining caking in the powder consisted of introducing 50 g of the composition to be tested into a 40×20×60 mm cardboard box with a permeability to water vapor, at 37.8° C. and 90% relative humidity, of approx. 2000 g/m$^2$/day, measured according to ASTM standard E96/53 T, procedure E.

The box was closed, weighed and stored at 37° C. at a relative humidity of 70%. After a predetermined period of storage, the box was reweighed, and its contents were placed on a sieve with a mesh size of 0.85 mm which was placed over a calibrated container. The whole unit was placed on a VENANZETTI VIBRIAZIONI Vibrator (frequency: 50 hertz, amplitude: 0.68 mm). The powder which had passed through the sieve during a measured sieving time was weighed, and the process repeated, as desired. The percentage of powder free from caking corresponds to the weight ratio of powder passing through the sieve compared with the presieved powder after storage, expressed as a percentage. It will be recognized that the higher the figure obtained in the test, the more effective has been the additive in preventing caking in the powder.

Examples 1 to 3 (comparative) and 4

Powder I was used as the base powder. Examples 1 to 3 were carried out as a comparison with a base powder containing no anticaking agent or containing only a single anticaking agent. Example 4 was carried out with a base powder containing the mixture of anticaking agents according to the invention. The specimens were stored for 5 days.

The amounts of anticaking agents incorporated, based on the resultant composition, and the results obtained in the caking test are given in Table II below.

TABLE II

| Example No. | 1 (comparative) | 2 (comparative) | 3 (comparative) | 4 |
|---|---|---|---|---|
| Anticaking agent, %, by weight, magnesium trisilicate 2 MgO . 3SiO$_2$ . 5,6H$_2$O. | 0 | 5 | 0 | 5 |
| sodium methyl naphthalene sulphonate | 0 | 0 | 0.5 | 0.25 |
| %, by weight of powder free from caking measured after: 15 sec | 13 | 4 | 92 | 98 |
| 30 sec | 18 | 6 | 93 | |
| 1 min | 28 | 12 | 96 | |
| 3 min | | 45 | | |

Examples 5 to 8 (comparative) and 9

Powder I was used as the base powder. Examples 5 to 8 were carried out as a comparison with a base powder containing no anticaking agent or containing only a single anticaking agent compound. Example 9 was carried out with a base powder containing the anticaking agent according to the invention. The specimens were stored for 10 days.

The amounts of anticaking agent incorporated, based on the resultant composition, and the results obtained in the caking test are given in Table III below.

TABLE III

| Example No. | 5 (comparative) | 6 (comparative) | 7 (comparative) | 8 (comparative) | 9 |
|---|---|---|---|---|---|
| Anticaking agent, % by weight magnesium trisilicate 2MgO. 3SiO$_2$ . 5, 6H$_2$O | 0 | 5 | 0 | 0 | 5 |
| sodium methyl naphthalene sulphonate | 0 | 0 | 0.25 | 0.5 | 0.25 |
| % by weight, of powder free from caking measured after: | | | | | |
| 15 sec | | | 17.4 | 45 | 94 |
| 30 sec | 4 | 0.5 | 27 | 60 | 95 |
| 1 min | 6 | | 42 | 73 | 96 |
| 3 min | 11 | 3 | 77.5 | 94 | |

Examples 10 to 12 (comparative and 13

Powder II was used as the base powder. Examples 10 to 12 were carried out as a comparison with a base powder containing no anticaking agent or containing only a single anticaking agent compound. Example 13 was carried out with a base powder containing the anticaking agent according to the invention. The specimens were stored for 5 days.

The amounts of anticaking agent incorporated, based on the resultant compositio, and the results obtained in the caking test are given in Table IV below.

TABLE IV

| Example No. | 10 (comparative) | 11 (comparative) | 12 (comparative) | 13 |
|---|---|---|---|---|
| Anticaking agent, % by weight magnesium trisilicate 2MgO . 3SiO$_2$ . 5, 6H$_2$O | 0 | 5 | 0 | 5 |
| sodium methyl naphthalene sulphonate | 0 | 0 | 0.5 | 0.25 |
| % by weight, of powder free from caking measured after: | | | | |
| 15 sec | 21 | 39 | 94 | 98 |
| 39 sec | 34 | 83 | | |
| 1 min | 53 | 87 | | |
| 3 min | | | 97 | |

Examples 14 to 17 (comparative) and 18

Powder II was used as the base powder. Examples 14 to 17 were carried out as a comparison with a base powder containing no anticaking agent or containing only a single anticaking agent compound. Example 18 was carried out with a base powder containing the anticaking agent according to the invention. The specimens were stored for 10 days.

The amounts of anticaking agent incorporated, based on the resultant composition, and the results obtained in the caking test are given in Table V below.

TABLE V

| Example No. | 14 (comparative) | 15 (comparative) | 16 (comparative) | 17 (comparative) | 18 |
|---|---|---|---|---|---|
| Anticaking agent, % by weight magnesium trisilicate 2MgO . $3SiO_2$ . 5, $6H_2O$ | 0 | 5 | 0 | 0 | 5 |
| sodium methyl naphthalene sulphonate | 0 | 0 | 0.25 | 0.5 | 0.25 |
| % by weight, of powder free from caking measured after: | | | | | |
| 15 sec | | | 8.4 | 11 | 90.3 |
| 30 sec | 3.5 | | 15 | 19 | |
| 1 min | 4.8 | | 29 | 35 | 92 |
| 3 min | 8.6 | 7.4 | 60 | 52 | |

Examples 19 to 22 (comparative) and 23

Powder III was used as the base powder. Examples 19 to 22 were carried out as a comparison with a base powder containing no anticaking agent or containing only a single anticaking agent compound. Example 23 was carried out with a base powder containing the anticaking agent according to the invention. The specimens were stored for 10 days.

The amounts of anticaking agent incorporated, based on the resultant composition, and the results obtained in the caking test are given in Table VI below.

TABLE VI

| Example No. | 19 (comparative) | 20 (comparative) | 21 (comparative) | 22 (comparative) | 23 |
|---|---|---|---|---|---|
| Anticaking agent, % by weight magnesium trisilicate 2MgO . $3SiO_2$ . 5, $6H_2O$ | 0 | 5 | 0 | 0 | 5 |
| sodium methyl naphthalene sulphonate | 0 | 0 | 0.25 | 0.5 | 0.25 |
| % by weight, of powder free from caking measured after: | | | | | |
| 15 sec | 23 | 4 | 10.5 | 80 | 97 |
| 30 sec | 29 | 6 | 17 | 88 | |
| 1 min | 36 | 8 | 30 | | |
| 3 min | 51 | 17 | 61.5 | | |

An examination of Tables II to VI shows that the simultaneous use of magnesium trisilicate and sodium methyl naphthalene sulphonate makes it possible to prevent caking whereas each of these products taken separately is insufficient to ensure this result.

It will be understood that the above description of the present invention is susceptible to various modifications, changes and adaptations, and the same are intended to be comprehended within the meaning and range of equivalents of the appended claims.

What is claimed is:

1. A particulate composition for washing and bleaching, which is resistant to caking, comprising:
   (a) active compounds consisting essentially of an alkali metal or ammonium carbonate and at least one peroxy compound selected from the group consisting of alkali metal or ammonium percarbonates, persulphates, and perborates; and
   (b) anticaking agents consisting essentially of
      (1) at least one alkali metal or ammonium aryl sulphonate, and
      (2) at least one water insoluble inorganic compound selected from the group consisting of compounds of magnesium and compounds derived from silica or alumina, said anticaking agent being present in an amount between 0.01 and 40% by weight, based on the total amount of said active compounds.

2. A composition according to claim 1 wherein said inorganic compound is magnesium trisilicate.

3. A composition according to claim 1 wherein said alkali metal or ammonium aryl sulphonate is sodium methyl naphthalene sulphonate.

4. A composition according to claim 1 wherein said peroxy compound is derived from a sodium salt.

5. A composition according to claim 4 wherein said peroxy compound is sodium percarbonate.

6. A composition according to claim 1 wherein the alkali metal or ammonium carbonate is sodium carbonate.

7. A composition according to claim 1 wherein the weight ratio of alkali metal or ammonium carbonate to peroxy compound is 0.05:1 to 20:1.

8. A composition according to claim 1 wherein said alkali metal or ammonium aryl sulphonate is unsubstituted, or is substituted by at least one alkyl group having from 1 to 6 carbon atoms.

9. A composition according to claim 1, wherein the compounds of magnesium are selected from the group consisting of magnesium oxide, magnesium hydroxide, magnesium carbonate, hydrated magnesium carbonate, magnesium orthophosphate, magnesium pyrophosphate, magnesium metaborate, magnesium orthoborate, talc, magnesium orthosilicate, magnesium metasilicate, magnesium trisilicate, vermiculite and fosterite.

10. A composition according to claim 1, wherein the compounds derived from silica or alumina are selected from the group consisting of silica gel, amorphous silica, kaolinite, micas, boehmite, aluminum phosphates, aluminum hydroxide, aluminum silicate, celite, kieselguhr, fuller's earth, talc, magnesium orthosilicate, magnesium metasilicate, magnesium trisilicate, vermiculite and fosterite.

11. A composition according to claim 1, wherein acid active compounds are present in an amount equal to at least 30% by weight of the composition.

12. A particulate composition for washing and bleaching, which is resistant to caking, consisting essentially of:
   (a) at least 30% by weight of active compounds consisting essentially of an alkali metal or ammonium carbonate and at least one peroxy compound selected from the group consisting of alkali metal or ammonium percarbonates, persulphates and perborates;
   (b) 0.01 to 40% by weight, based on the total amount of said active compounds, of anticaking agents consisting essentially of at least one alkali metal or ammonium aryl sulphonate and at least one water insoluble inorganic compound selected from the group consisting of compounds of magnesium and compounds derived from silica or alumina;
   (c) 0.01 to 70% by weight of fillers; and
   (d) not more than 20% by weight of other constituents useful for washing and bleaching purposes.

13. A particulate composition for washing and bleaching, which is resistant to caking, comprising: a base powder containing substantially, by weight, 30% sodium percarbonate, 60% sodium carbonate and 10% sodium sulphate; magnesium trisilicate in a concentration of approximately 5%, by weight, of said composition; and sodium methyl naphthalene sulphonate in a concentration of approximately 0.25%, by weight, of said composition.

14. A particulate composition for washing and bleaching, which is resistant to caking, comprising: a base powder containing, substantially, by weight, 30% sodium percarbonate, 40% sodium carbonate, 10% sodium sulphate, and 20% sodium chloride; magnesium trisilicate in a concentration of approximately 5%, by weight, of said composition; and sodium methyl naphthalene sulphonate in a concentration of approximately 0.25%, by weight, of said composition.

15. A particulate composition for washing and bleaching, which is resistant to caking, comprising: a base powder containing substantially, by weight, 45% tetrahydrated sodium perborate, 45% sodium carbonate and 10% sodium sulphate; magnesium trisilicate in a concentration of approximately 5%, by weight, of said composition; and sodium methyl naphthalene sulphonate in a concentration of approximately 0.25%, by weight, of said composition.

* * * * *